United States Patent [19]

Jano et al.

[11] Patent Number: 4,634,271

[45] Date of Patent: Jan. 6, 1987

[54] LASER DEVICE FOR GUIDING A MISSILE TO A TARGET

[75] Inventors: Patrice Jano, Chilly Mazarin; Michèle Tron, Ville d'Avray, both of France

[73] Assignee: Compagnie Industrielle des Lasers Cilas Alcatel, Marcoussis, France

[21] Appl. No.: 699,380

[22] Filed: Feb. 7, 1985

[30] Foreign Application Priority Data

Feb. 7, 1984 [FR] France ..... 84 01842

[51] Int. Cl.[4] ..... G01C 3/08; F41G 7/26

[52] U.S. Cl. ..... 356/5; 244/3.13

[58] Field of Search ..... 356/5; 244/3.13

[56] References Cited

U.S. PATENT DOCUMENTS 4,234,141 11/1980 Miller, Jr. et al. ..... 244/3.13
4,516,853 5/1985 Pearson ..... 356/5

FOREIGN PATENT DOCUMENTS 2109488 5/1972 France .
2319871 2/1977 France .
2444281 7/1980 France .
1350002 4/1974 United Kingdom .
1529388 10/1978 United Kingdom .
2041685 9/1980 United Kingdom .

*Primary Examiner*—L. T. Hix
*Assistant Examiner*—David M. Gray
*Attorney, Agent, or Firm*—Sughrue, Mion, Zinn, Macpeak and Seas

[57] ABSTRACT

A laser device for guiding a missile to a target such as an enemy tank, includes a laser transmitter (1) which transmits radiation (2) which is received by a modulator (30) capable of delivering two distinct pulsed beams (51, 52) in response thereto. The first beam (51) is directed to a missile (7) to measure the angle and the distance of the missile and to convey piloting instructions thereto by modulation of said pulses, and the second beam (52) is directed towards a target (55) by a reflector (54) mounted on an aiming sight (22) in order to measure the distance to the target. The device further includes a computer (28) for determining the trajectory to be followed by the missile towards the target on the basis of the distances to the missile and to the target and on the basis of the angle between said distances.

4 Claims, 10 Drawing Figures

LASER DEVICE FOR GUIDING A MISSILE TO A TARGET

The present invention relates to a laser device for guiding a missile to a target.

BACKGROUND OF THE INVENTION

French published patent specification describes a laser device for guiding a missile to a target, in which the missile is launched towards a target and including flight controller means for modifying the direction of its movement. This prior device is of the type comprising:

a guidance station including:

an automatic missile pointing system comprising:

a laser beam generator, including a transmitter for transmitting laser radiation at a frequency $F_1$, said generator being provided with beam pointing means for pointing the beam towards a target which returns a portion of the beam energy in the opposite direction;

an error measuring system fitted with an electro-optical receiver disposed to receive the said returned portion of energy, the receiver being suitable for delivering an error measuring signal in response thereto representative of the angle of error between the position of the missile and the axis of the beam; and a servo-control circuit suitable for controlling the beam pointing means to reduce the angle of error;

means for measuring the distance of the missile, said means comprising:

a modulator constituting a part of the said generator, said modulator being suitable for receiving the laser radiation delivered by the transmitter and for delivering laser pulses at the frequency $F_1$ in response thereto; and a missile telemeter circuit, connected to the modulator and to the output of the electro-optical receiver to measure the time interval between the tranmission of a laser pulse at the frequency $F_1$ and its return to the receiver after being returned from the missile, said time interval being representative of the missile;

means for measuring the distance of the target;

an aiming sight which is pointable towards the target;

angle measuring means for delivering information on the angular position of the missile, said position being determined by the said pointing means, the angular position information being relative to the direction in which the sight is pointed;

a computer connected to the missile telemeter circuit, to the said means for measuring the distance to the target, and to the said angle measuring means, said computer being capable firstly of determining a trajectory for the missile towards the target on the basis of the information on the distance to the missile, on the distance to the target, and on the angular position of the missile, and also capable of generating piloting signals suitable for controlling the said flight controller means to guide the missile on said trajectory; and a modulator control circuit connected to the computer to modulate the said laser pulses at the frequency $F_1$ with the said piloting signals;

and a laser beam receiver circuit disposed on board the missile and connected to the said flight controller means, said circuit being capable of receiving the said modulated laser pulses at frequency $F_1$ and of delivering the said piloting signals in response thereto;

In this laser device, the means for measuring the distance to the target comprises a telemeter fixed to the aiming sight. This telemeter may be a laser telemeter, for example, in which case, the device includes two laser transmitters:

a first laser transmitter serving, together with a receiver and a telemeter circuit, for telemtery of the missile and for automatic missile pointing, said first laser transmitter being capable also of serving to transmit piloting signals to the missile; and a second laser transmitter for target telemetry.

The aim of the present invention is to improve the device described in the above-mentioned published French patent specification No. 2 525 339 so that all the above-mentioned functions can be performed by a single laser transmitter.

SUMMARY OF THE INVENTION

The present invention provides a device for guiding missiles to a target or the above-defined type, wherein the said beam is a first beam, the said modulator is also capable of delivering a second beam at a second frequency $F_2$ different from the frequency $F_1$; and the means for measuring the distance to the target comprise:

a reflector fixed to the aiming sight to direct the second beam towards the target; and a pulse receiver system for receiving pulses from the second beam as reflected by the target, said system being fixed to the aiming sight and being connected to the computer, said system being capable of measuring the time interval between transmitting a laser pulse of frequency $F_2$ and its return to the guidance station after reflection by the target, said time interval being representative of the distance to the target.

BRIEF DESCRIPTION OF THE DRAWINGS

Embodiments of the invention are described by way of example with reference to the accompanying drawings, in which.

MORE DETAILED DESCRIPTION

Figure 1:
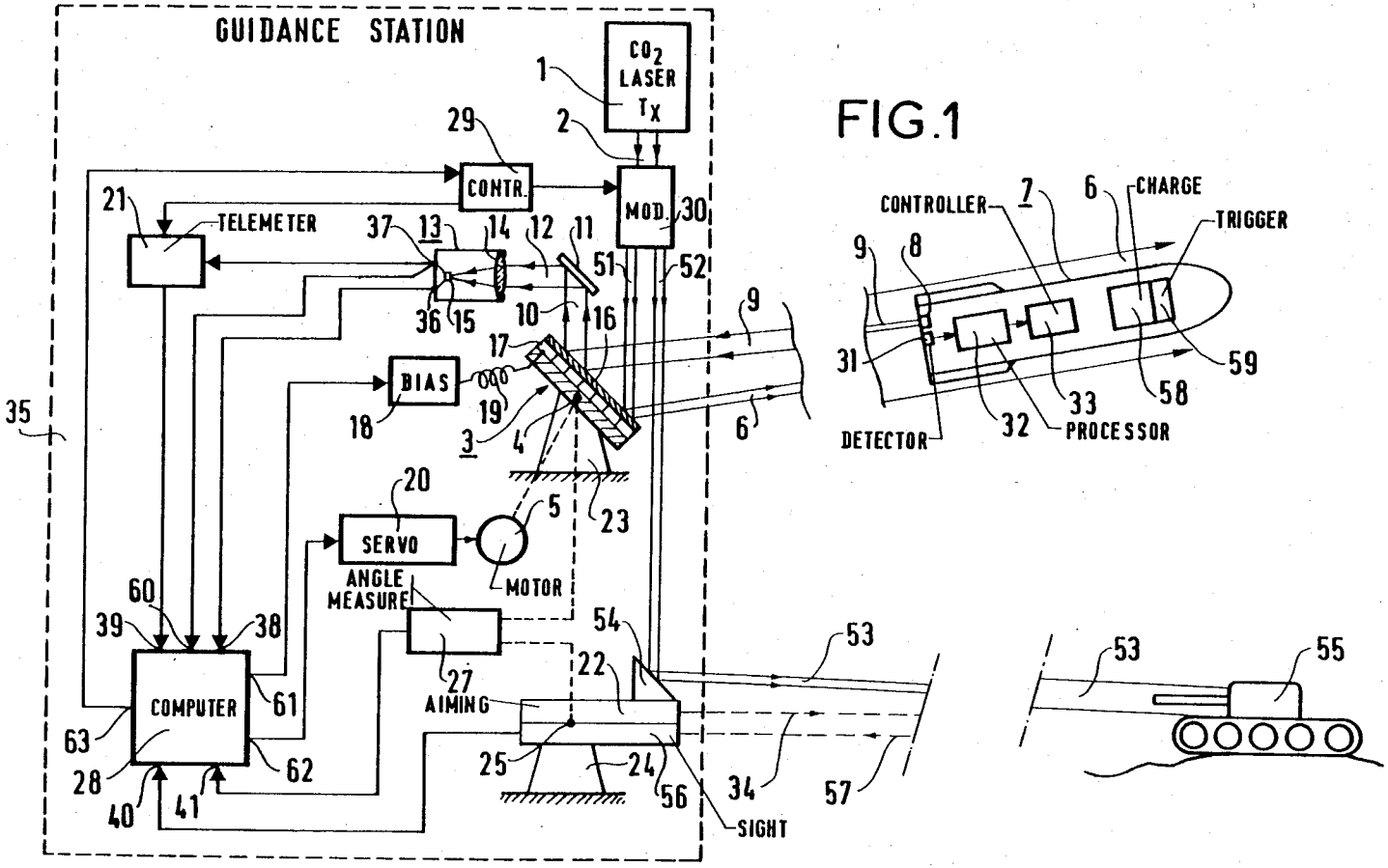
FIG. 1 is a diagram of a first embodiment of a device in accordance with the invention.
Figure 2:
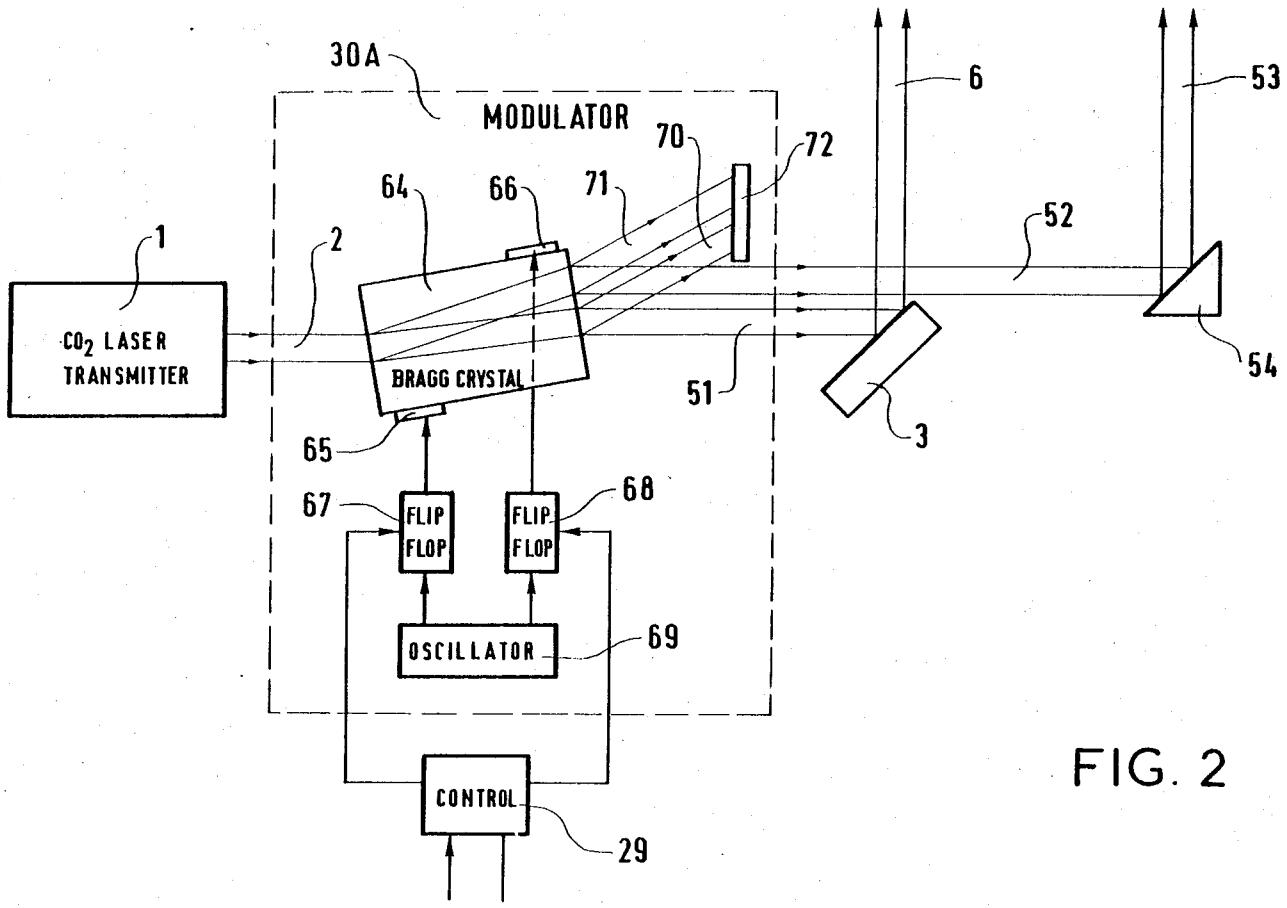
FIG. 2 is a diagram of a portion of the device showing the preferred embodiment of the modulator which constitutes a portion of the device shown in FIG. 1.
Figure 4:
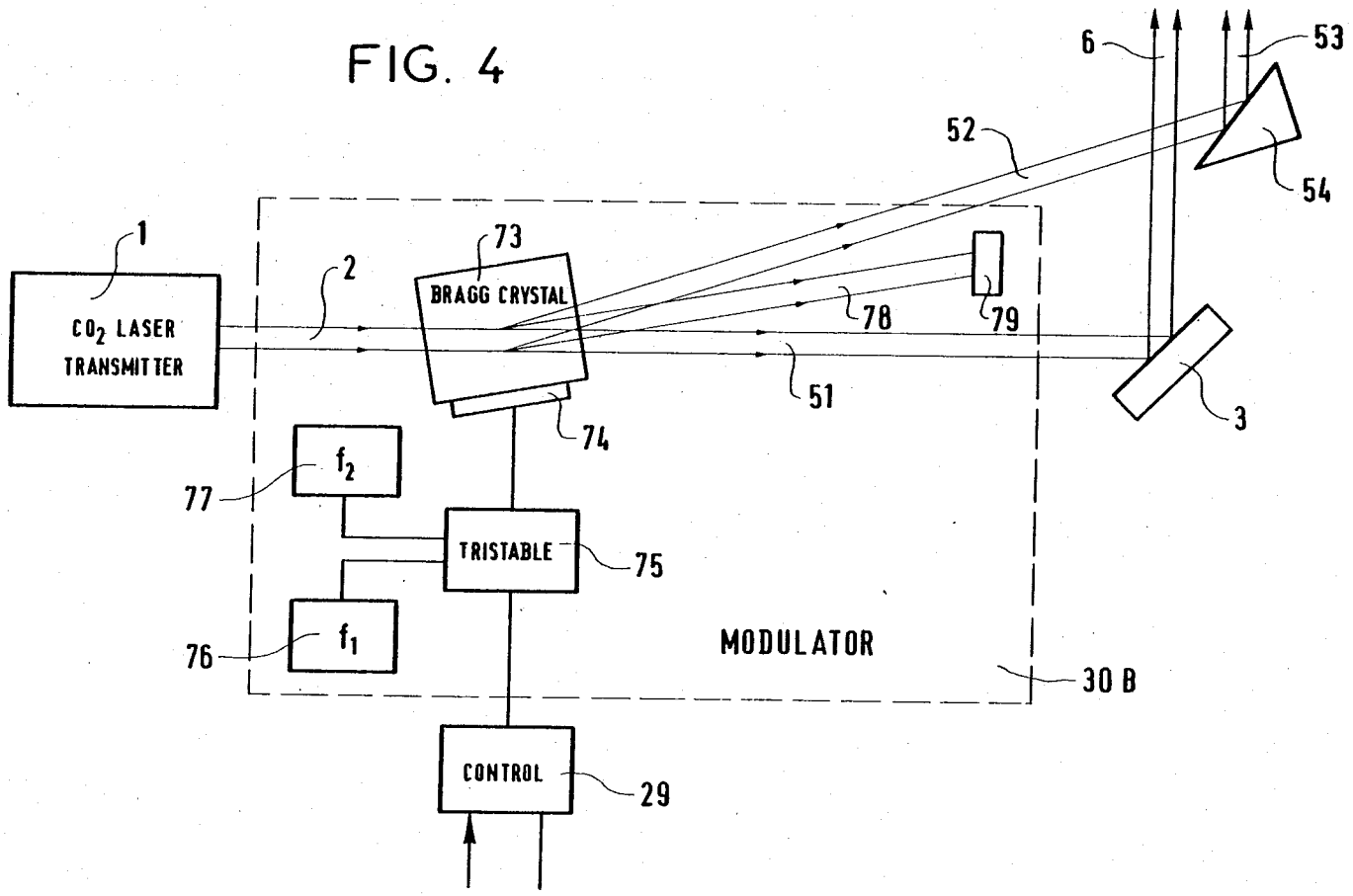
FIG. 4 is a view of a portion of the device showing a variant embodiment of the modulator which constitutes a part of the device shown in FIG. 1.

Naturally, when similar components are shown in FIGS. 1, 2 and 4, they are given the same reference numerals.

In FIG. 1, a carbon dixoide laser transmitter 1 transmits a continuous beam 2 of infrared radiation at a wavelength of 10.6 microns. The beam 2 enters a modulator 30 which is connected to a modulator control circuit 29. Two beams 51 and 52 leave the modulator 30.

The beam 51 is received by a mirror 3 which is rotatably mounted in azimuth and in elevation about a knuckle 4 fixed on a support 23, with rotation of the mirror 3 being driven by electric motors such as 5.

The mirror 3 reflects the beam 51 to constitute a missile-illuminating beam 6 for illuminating a missile 7. The missile is preferably equipped with a rear retro-reflector such as 8 for returning a beam 9 in the reverse direction back to the mirror 3. The return beam 9 is reflected by the mirror 3 along a beam 10 which is itself reflected by a mirror 11 to give a beam 12 which enters an error measuring system 13. The system 13 includes a lens 14 for concentrating the beam 12 on the sensitive surface of a four-quadrant photoelectric receiver.

The mirror 3 is an adapting mirror whose reflecting surface is deformable under the action of a plurality of piezoelectric transducers such as 17. Each transducer 17 includes two electrodes which are connected to an electrical biasing circuit 18 by connections such as 19.

A servo-control circuit 20 is connected to the motors 5.

A telemeter circuit 21 is connected to the control circuit 29 and to an electrical output 37 from the receiver 15.

A pointable aiming sight 22 is mounted on a base 24 about a knuckle joint 25.

The beam 52 from the modulator 30 is reflected along a beam 53 by a mirror 54 on the sight 22 towrads a target 55 such as a tank. A telemeter receiver system 56 fixed to the sight 22 has a receiver axis 57 along which it receives a portion of the laser energy of the beam 53 as reflected by the target 55. The receiver axis 57 is parallel to the optical axis 34 of the sight 22.

An angle measuring system 27 determines the orientation of the mirror 3 relative to the orientation of the sight 22.

A computer 28 has five inputs 39, 60, 38, 41, and 40 respectively connected to the telemeter circuit 21, to the output 37 from the receiver 15, to another output 36 from the receiver 15, to the angle measuring system 27, and to the telemeter receiver 56.

The computer 28 has three outputs 61, 62 and 63 respectively connected to the bias circuit 18, to the servocontrol circuit 20 and to the control circuit 29.

The missile 7 is fitted with a receiver circuit comprising a photoelectrical detector 31 disposed at the rear of the missile, the electrical output from the detector 31 being connected to the input of a processor circuit 32. The output from the circuit 32 is connected to a flight controller unit 33 capable of modifying the direction of missile travel. The missile 7 further includes an explosive charge 58 close to which there is a system 59 capable of triggering as explosion of the charge 58 when the missile impacts against a target.

As shown in FIG. 1, the components referenced 1 to 5, 10 to 30, 38 to 41, 56, and 60 to 63 are combined in a guidance station 35, which may be situated on the ground in a military vehicle.

The missile 7 is launched towards a moving target to be destroyed as represented in FIG. 1 by an enemy tank 55.

The transmitted laser beam 6 is pointed towards the missile 7 by means of an acquisition device (not shown).

The beam 9 as returned by the retro-reflectors 8 fixed on the missile, and after reflection by the moving mirror 3 and the fixed mirror 11, is concentrated by the lens 14 on the four quadrant receiver 15. The electrical output 37 of the receiver 15 delivers a signal represenative of the intensity of the laser radiation returned by the missile. The error measuring output 36 of the receiver 15 delivers a signal represenative of the angular error between the position of the missile and the axis of the laser beam.

The error signal is applied to the computer 28 which can thus calculate the direction of the missile given the orientation of the mirror 3, and which applies corresponding information to the servo-control circuit 20.

The servo-control circuit then controls the motors 5 to cause the mirror to rotate about the knuckle 4 in such a manner as to reduce the error angle. The mirror 3 thus tracks the missile 7 automatically.

Further, the electrical output 37 is connected to the input 60 of the computer 28 which issues instructions for biasing the electrodes of the piezoelectic transducers 17 of the adaptive mirror 3. As a result, the reflecting surface 16 of the mirror 3 is deformed in such a manner as to increase the concentration of the laser beam 6 on the missile 7. This increases the amplitude of the electrical signal delivered at the output 37 of the receiver 15.

One embodiment 30A of the modulator 30 is shown in FIG. 2. It comprises a Bragg-effect crystal 64 disposed on the path of the beam 2 transmitted by the laser 1. The mechanical outlet of the two piezoelectrical electromechanical transducers 65 and 66 are applied against the crystal. Two bistable circuits 67 and 68 are connected to the modulator control circuit 29 and to the electrical inputs of respective ones of the transducers 65 and 66. Each of the bistable circuits 67 and 68 has one input connected to a respective output of an acoustic frequency generator operating at a frequency $f_2$.

The modulator shown in FIG. 2 operates as follows.

The bistable circuits 67 and 68 are identical and each of them has two positions of stable equilibrium. In a first equilibrium position of the circuit 67 (or 68) the electrical input of the transducer 65 (66) is not connected to the output of the generator 69; while in the second equilibrium position of the circuit 67 (or 68), the electrical input of the transducer 65 (or 66) is connected to the output of the genertor 69.

The control circuit 29 of the modulator 30A serves to switch the two bistables sequentially over their equilibrium positions.

When both bistables are in their first stable equilibrium position, neither of the transducers 65 and 66 is powered by the generator 69 and the laser beam transmitted by the transmitter 1 is normally refracted by the crystal to leave via the beam 51. In the example shown in FIG. 2, where the inlet and outlet faces of the crystal are parallel to each other, the beam 51 leaves parallel to the beam 2. Naturally, the frequency of the beam 51 is equal fo the frequency $F_1$ of the beam 2.

When only one of the two bistable circuits is in its first equilibrium position and the other is in its second equilibrium position, one of the transducers is powered by the generator 69 at the acoustic frequency $f_2$. As a result, acoustic waves are formed in the crystal 64, thus deflecting the refracted beam and also changing its frequency. The diffracted beam leaves the crystal as beam 70 (or 71) when the transducers 65 (or 66) are powered. These beams 70 and 71 are deflected relative to the beam 51 by an angle which depends on the acoustic frequency $f_2$. In practice the beams 70 and 71 are not used for operation of the device and absorbent material 72 is placed on their path.

When both bistables are in their second position of stable equilibrium, both transducers 65 and 66 are powered by the generator 69. These transducers are disposed on the surface of the crystal in such a manner that the acoustic waves which they inject into the crystal cause an output beam 52 to be generated which is parallel to the output beam 51 but which is offset relative thereto. The frequency $F_2$ of the radiation in the beam 52 differs from the frequency $F_1$ of the beam 51 by the amount $f_2$ of the acoustic frequency emitted by the generator 69. For example:

$$F_2=F_1+f_2$$

The continuous beam 2 transmitted by laser transmitter 1 is modulated under the control of the control circuit 29 which sequentially switches the bistable circuits 67 and 68 between their positions of stable equilibrium.

Thus, for example, with the bistable 67 remaining in its first position of stable equilibrium, the control circuit 29 causes the other bistable 68 to alternate between its first and second positions of stable equilibrium, thereby cutting up the beam into a sequence of short duration pulses so that the beam 51 is in the form of a sequence of pulses.

With reference to FIG. 1, these pulses are sent towards the missile 7, along the beam 6 after reflection at the mirror 3. The pulses are returned by the missile and received by the receiver 15 which delivers a return signal on its output 37 which is connected to the telemeter circuit 21. The telemeter includes a clock for measuring the time interval which elapses between a laser pulse being transmitted towards the missile and the same pulse being received by the receiver 15. The telemeter circuit 21 thus provides information on the distance to the missile.

The sequential switching of the bistable circuits 67 and 68 may also include the bistable 68 remaining in its second position of stable equilibrium, with the bistable 67 alternating between its first and second positions. This alternation serves to chop the continuous laser beam into short duration pulses, such that the beam 52 is also in the form of a sequence of pulses (see FIG. 2).

The beam 52 is reflected by the mirror 54 along a beam 52. The operator points the aiming sight 22 at the target and thus directs the beam 53 which lies parallel to the axis 34 of the sight towards the target.

The target 55 returns a portion of the pulse energy of the beam 53 to the receiver circuit 56 which is analogous to the telemeter 21 and which serves to deliver information on the distance to the target at desired moments and at regular time intervals.

The angle measuring system 27 is of known type and delivers two items of information at its output defining the angular position of the missile relative to a frame of reference based on the pointable sight 22.

The computer 28 receives the information concerning the distance of the missile and the target from the station 35 via inputs 39 and 40, and it likewise receives the two items of information concerning the angular position of the missile via input 41. On the basis of this information, the computer is capable of determining the angle subtended at the station 35 by the missile and the target.

The computer thus disposes of all the information required to solve the triangle formed by the station 35, the missile 7 and target. The computer is also capable of determining a missile trajectory suitable for going from its current position to the target. This trajectory is preferably determined in such a manner that the laser beam remains above the target and does not return to it until the end of the trajectory. This is to reduce the chances of the station 35 being revealed to the enemy by the missile-controlling laser beam.

The computer is also capable of generating piloting signals from the missile flight controller 33 so as to ensure that the missile follows the trajectory determined therefor.

The piloting signals are transmitted to the modulator control circuit 29 so as to modulate the sequence of pulses in the laser beam 51 with the piloting signals. This sequence of pulses is position modulated by shifting the instants at which successive pulses are transmitted.

FIGS. 3A, 3B, 3C and 3D are diagrams showing a particular form of sequential switching for the bistables 67 and 68.

Figure 3A:
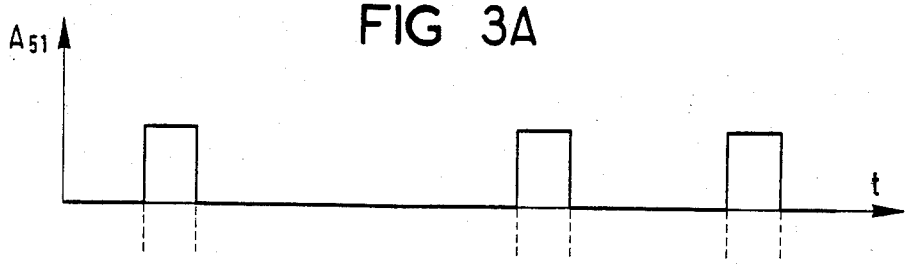
FIGS. 3A, 3B, 3C and 3D are signal diagrams showing the operation of the device shown in FIGS. 1 and 2.

FIG. 3A shows the amplitude $A_{51}$ as a function of time of the beam 51 with the bistable 67 remaining in its first equilibrium position and the bistable 68 alternating between its two positions. This switching is performed so as to obtain a sequence of short duration pulses, which pulses are position modulated, ie. they are time-shifted, by the piloting signals generated by the computer.

Figure 3B:
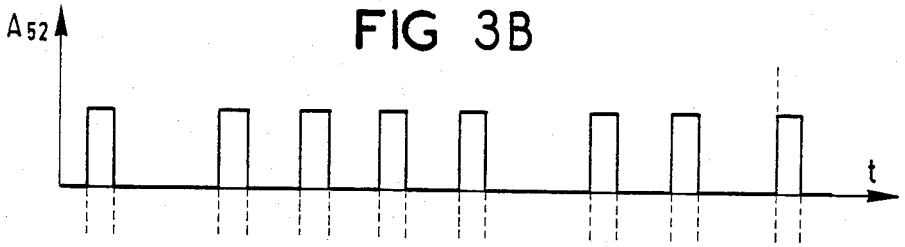

FIG. 3B shows the amplitude $A_{52}$ of the energy of the beam 52 with the circuit 68 remaining in its second equilibrium position and the circuit 67 alternating between its two positions. This switching is performed to obtain a sequence of short duration pulses disposed between the successive pulses of the beam 51.

Figure 3C:
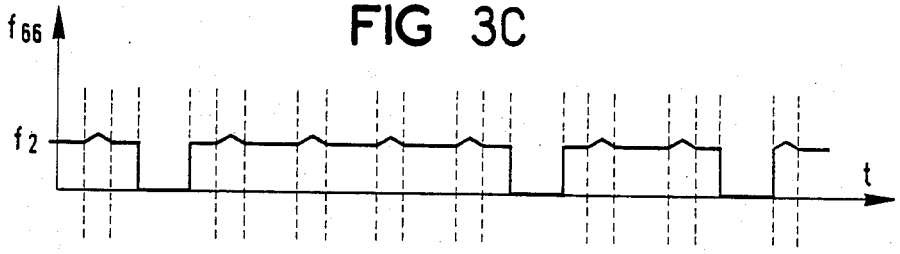
Figure 3D:
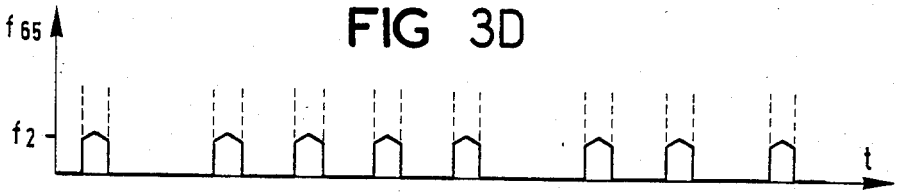

Finally, FIGS. 3C and 3D show the acoustic frequency of the current powering transducers 66 and 65 as a function of time. It can be seen on these two diagrams that the frequency $f_2$ of the current delivered by the generator 69 varies as a function of time while this current is being applied to the transducer 65. The variation in frequency comprising a rising slope followed by a falling slope. These two slopes are linear and of the same duration with equal gradients of opposite sign. The variation in the frequency $f_2$ makes it possible to incorporate means in the receiver 56 for measuring the speed of the target by the doppler effect. By using symmetrical slopes in the frequency variation cycle, it is possible to compress the duration of the pulses on reception using a well known technique, thereby improving the telemeter performance as well as the measurements of target speed.

The beam 51 is sent to the missile by reflection on the mirror 3 and along the beam 6. The missile receiver 31 receives the sequence of position modulated pulses conveyed by the beam 6 and the processor circuit 32 delivers piloting signals which are applied to the flight controller 33 so as to guide the missile progressively to the target.

The device described above with reference to FIGS. 1 and 2 is thus capable of guiding a missile to a target. The device uses a single laser 1 and by means of the modulator 30 forms therefrom two distinct beams (51 and 52). The beam 51 serves to measure angles of error and distance, and also to convey instructions to the missile. The beam 52 measures the distance to the target and may also measure target speed.

The type of modulator 30A shown in FIG. 2 includes two transducers and has the advantage of producing two beams (51 and 52) which are parallel to each other and which propagate along a direction which is independent of the acoustic frequency generator, thereby considerably facilitating the optics concerning the beams leaving the modulator.

FIG. 4 shows another embodiment 30B of the modulator 30. It comprises a Bragg effect crystal 73 disposed on the path of the beam 2 emitted by the laser transmitter 1. The mechanical output of a single piezoelectrical electromechanical transducer 74 is applied therto. A tristable circuit 75 is connected to the electrical input of the transducer 74 and to the modulator control circuit 29. The tristable circuit 75 has two inputs connected to respective acoustic frequency generators 76 and 77 which generate signals at frequencies $f_1$ and $f_2$.

The tristable 75 has three positions of stable equilibrium, namely: a first position of stable equilibrium in which the electrical input to the transducer 74 is connected to neither frequency generator; a second position in which it is connected solely to the generator 76 at frequency $f_1$; and a third position in which it is connected solely to the generator 77 at frequency $f_2$.

The modulator control circuit 29 switches the tristable sequentially between its three positions of stable equilibrium.

When the tristable is in its first position, the laser radiation 2 leaves the crystal along a beam 51 at a frequency $f_1$ which is equal to the radiation frequency transmitted by the laser transmitter 1.

When the tristable is in its second position, the laser beam 78 leaving the crystal is deflected angularly relative to the beam 51. This beam 78 is not used in operation of the device and it is absorbed by absorbent material 79.

When the tristable 75 is in its third equilibrium position, the laser beam 52 leaving the crystal is also angularly deflected relative to the beam 51, and is at a frequency:

$$F_2 = F_1 + f_2$$

Since the angle of deflection depends on the frequency applied to the transducer 74, and since $f_1$ is different from $f_2$, all three beams 51, 78 and 52 are mutually distinct.

When the circuit 29 causes the tristable to alternate between its first and second equilibrium positions, pulses are formed in the beam 51. The successive pulses formed in this way are time shifted so as to be position modulated by the piloting signals generated by the computer. These pulses are shown in FIG. 5A which shows the variations as a function of time in the amplitude $A_{51}$ of the radiation in the laser beam 51.

When the circuit 29 causes the tristable to alternate betweens its second and third equilibrium positions, pulses are formed in the beam 52. These pulses are shown in FIG. 5B which shows variations as a function of time in the amplitude $A_{52}$ of the radiation in the laser beam 52.

Figure 5A:
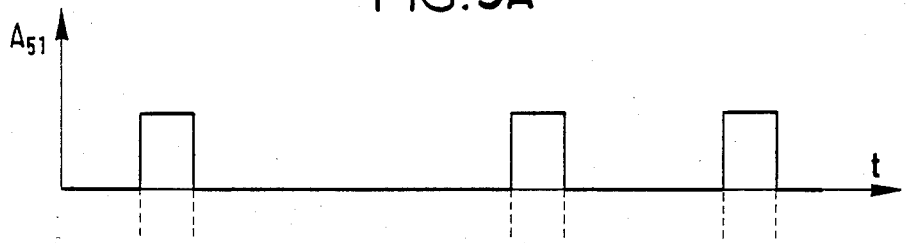
FIGS. 5A, 5B and 5C are signal diagrams showing the operation of the device shown in FIGS. 1 and 4.
Figure 5B:
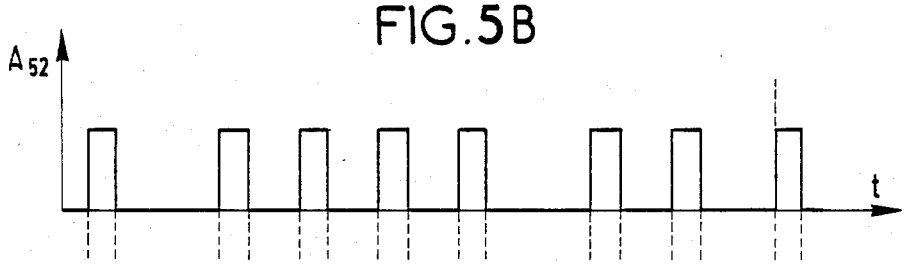
Figure 5C:
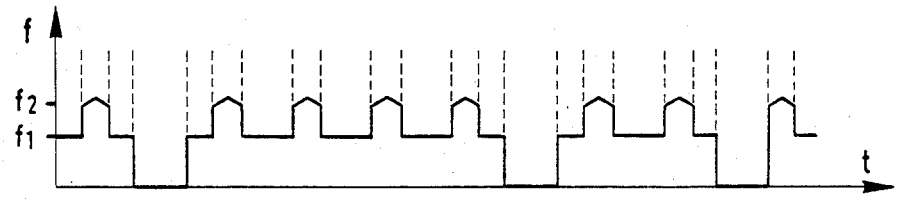

FIGS. 5A, 5B, and 5C are diagrams showing an example of sequential switching of the tristable circuit. FIG. 5C shows the variations as a function of time in the frequency f applied to the transducer 74. This frequency switches between O, $f_1$ and $f_2$. Further, as can be seen in FIG. 5C, the frequency $f_2$ varies as a function of time and follows a rising slope and then a falling slope of equal duration so as to make it possible to measure the speed of the target and to use a receiver circuit 56 capable of performing pulse duration compression.

We claim:

1. A laser device for guiding a missile to a target, the missile being launched towards the target and including flight controller means for modifying the direction of its movement, the laser device comprising:

a guidance station including:

an automatic missile pointing system comprising:

a laser beam generator, including a transmitter for transmitting laser radiation at a frequency $F_1$, said generator being provided with beam pointing menas for pointing the beam towards a target which returns a portion of the beam energy in the opposite direction;

an error measuring system fitted with an electro-optical receiver disposed to receive said returned portion of energy, the receiver being suitable for delivering an error measuring signal in response thereto representative of the angle of error between the position of the missile and the axis of the beam; and a servo-control circuit suitable for controlling the beam pointing means to reduce the angle of error;

means for measuring the distance of the missile, said means comprising:

a modulator constituting a part of the said generator, said modulator being suitable for receiving the laser radiation delivered by the transmitter and for delivering laser pulses at the frequencey $F_1$ in response thereto; and a missile telemeter circuit, connected to the modulator and to the output of the electro-optical receiver to measure the time interval between the transmission of a laser pulse at the frequency $F_1$ and its return to the receiver after being returned from the missile, said time interval being representative of the missile distance;

means for measuring the distance of the target;

an aiming sight which is pointable towards the target;

angle measuring means for delivering information on the angular position of the missile, said position being determined by the said pointing means, the angular position information being relative to the direction in which the sight is pointed;

a computer connected to the missile telemeter circuit, to the said means for measuring the distance to the target, and to the said angle measuring means, said computer being capable firstly of determining a trajectory for the missile towards the target on the basis of the information on the distance to the missile, on the distance to the target, and on the angular position of the missile, and also capable of generating piloting signals suitable for controlling the said flight controller means to guide the missile on said trajectory; and a modulator control circuit connected to the computer to modulate the said laser pulses at the frequency $F_1$ with the said piloting signals;

and a laser beam receiver circuit disposed on board the missile and connected to the said flight controller means, said circuit being capable of receiving the said modulated laser pulses at frequency $F_1$ and of delivering the said piloting signals in response thereto;

the laser device including the improvement wherein the said beam is a first beam, the said modulator is also capable of delivering a second beam at a second frequency $F_2$ different from the frequency $F_1$; and the means for measuring the distance to the target comprise:

a reflector fixed to the aiming sight to direct the second beam towards the target; and a pulse receiver system for receiving pulses from the second beam as reflected by the target, said system being fixed to the aiming sight and being connected to the computer, siad system being capable of measuring the time interval between transmitting a laser pulse of frequency $F_2$ and its return to the guidance station after reflection by the target, said time interval being representative of the distance to the target.

2. A device according to claim 1, wherein:

the modulator comprises:

a Bragg effect crystal disposed on the path of the laser radiation at frequency $F_1$, at the output from the laser transmitter;

an electromechanical trandsducer having a mechanical output applied against the crystal;

a tristable circuit connected to the modulator control circuit and to the electrical input of the transducer, said tristable circuit having two inputs and three positions of stable equilibrium; and two acoustic frequency generators operting at different respective frequencies $f_1$ and $f_2$, the frequency generators being connected to respective ones of the inputs to the tristable circuit, with the electrical input of the transducer being conneced to neither of the frequency generators when the tristable circuit is in a first equilibrium position, with the electrical input of the transducer being connected solely to the generator of the frequency $f_1$ when the tristable circuit is in its second equilibrium position, and with the electrical input of the transducer being connected solely to the generator of the frequency $f_2$ when the tristable circuit is in its third equilibrium position;

and the modulator control circuit being capable of sequentially switching the tristable circuit over its three equilibrium positions in such a manner that when the tristable circuit is in its first position the laser radiation leaves the crystal in a first direction and at a frequency $F_1$, when the tristable is in its second position the laser radiation is deflected relative to the first direction to leave the crystal along a second direction, and when the tristable is in its third position the laser radiation is deflected relative to the first direction and leaves the crystal along a third direction and the frequency $F_2$ of said radiation differs from the frequency $F_1$ by the value $f_2$, the laser radiation deflected along the second direction being unused, the first laser beam being constituted by the laser radiation leaving the crystal along the first direction, with the pulses being formed therein by alternating the tristable between its first and its second positions, and the second laser beam being constituted by the laser radiation leaving the crystal along the third direction, with the pulses being formed therein by alternating the tristable between its second position and its third position.

3. A device according to claim 1, wherein:

the modulator comprises:

a Bragg effect crystal disposed on the path of the laser radiation at frequencey $F_1$, at the output from the laser transmitter;

two electromechanical transducers having their mechanical outputs applied against the crystal;

two bistable circuits connected to the modulator control circuit and to respective electrical inputs of the transducers, each bistable circuit having one input and two positions of stable equilibrium; and an acoustic frequency generator operating at an acoustic frequency $f_2$, the frequency generator being connected to the inputs of both bistable circuits, with the electrical input of each transducer being disconnected from the frequency generator when the bistable circuit connected thereto is in a first equilibrium position, and with the electrical input of each transducer being connected to the frequency generator when the bistable circuit connected thereto is in its second equilibrium position;

and the modulator control circuit being capable of sequentially switching the two bistable circuits over their equilibrium positions in such a manner that when both bistable circuits are in their first position the laser radiation leaves the crystal in a first direction and at a frequency $F_1$, when only one of the bistable circuits is in its second position and the other is in its first position the laser radiation is deflected relative to the first direction to leave the crystal along a second direction, and when both bistable circuits are in their second positions the disposition of the transducers on the crystal is such that the laser radiation is deflected relative to the first direction and leaves the crystal along a third direction parallel to the first direction, and the frequency $F_2$ of said radiation differs from the frequency $F_1$ by the value $f_2$, the laser radiation deflected along the second direction being unused, the first laser beam being constituted by the laser radiation leaving the crystal along the first direction, with the pulses being formed therein by alternating one of the bistables between its first and its second positions, while the other bistable is in its first position, and the second laser beam being constituted by the laser radiation leaving the crystal along the third direction, with the pulses being formed therein by alternating one of the bistables between its second position and its first position, while the other bistable is in its second position.

4. A device according to claim 2 or 3, wherein the frequency $f_2$ varies as a function of time: initially rising in frequency and then falling in frequency for the same period of time in a linear manner with the same gradient but opposite signs.

* * * * *